United States Patent [19]

Frohbieter

[11] Patent Number: 4,732,014

[45] Date of Patent: Mar. 22, 1988

[54] TEMPERATURE CONTROLLED COMPARTMENT FOR A REFRIGERATOR

[75] Inventor: Edwin H. Frohbieter, Lincoln Township, Berrien County, Mich.

[73] Assignee: Whirlpool Corporation, Benton Harbor, Mich.

[21] Appl. No.: 948,124

[22] Filed: Dec. 31, 1986

[51] Int. Cl.[4] ..... F25D 25/02

[52] U.S. Cl. ..... 62/382; 62/408

[58] Field of Search ..... 62/382, 408

[56] References Cited

U.S. PATENT DOCUMENTS

| | | | |
|---|---|---|---|
| 3,090,209 | 5/1963 | Hubacker | 62/180 |
| 3,108,455 | 10/1963 | Hanson | 62/382 |
| 3,364,694 | 1/1968 | Cohen et al. | 62/265 |
| 3,473,345 | 10/1969 | Pfeiffer et al. | 62/408 |
| 3,600,905 | 8/1971 | Dymek et al. | 62/382 |
| 3,638,717 | 2/1972 | Harbour et al. | 165/30 |
| 3,659,429 | 5/1972 | McLean | 62/419 |
| 4,229,945 | 10/1980 | Griffin | 62/229 |
| 4,557,118 | 12/1985 | Pink et al. | 62/382 |

OTHER PUBLICATIONS

Sanyo advertising brochure, Mar. 1985.

*Primary Examiner*—Lloyd L. King

*Attorney, Agent, or Firm*—Hill, Van Santen, Steadman & Simpson

[57] ABSTRACT

A refrigerator is provided which has a compartment to be chilled below the temperature of the remainder of the main refrigerator compartment and which has an openable container therein. The container is provided with apertures therethrough near the front wall such that a stream of temperature conditioned air is caused to flow around the outer surface of the container within the compartment and to flow through the interior of the container, particularly across the inside surface of the front wall, to provide a minimal temperature gradient within the container.

27 Claims, 6 Drawing Figures

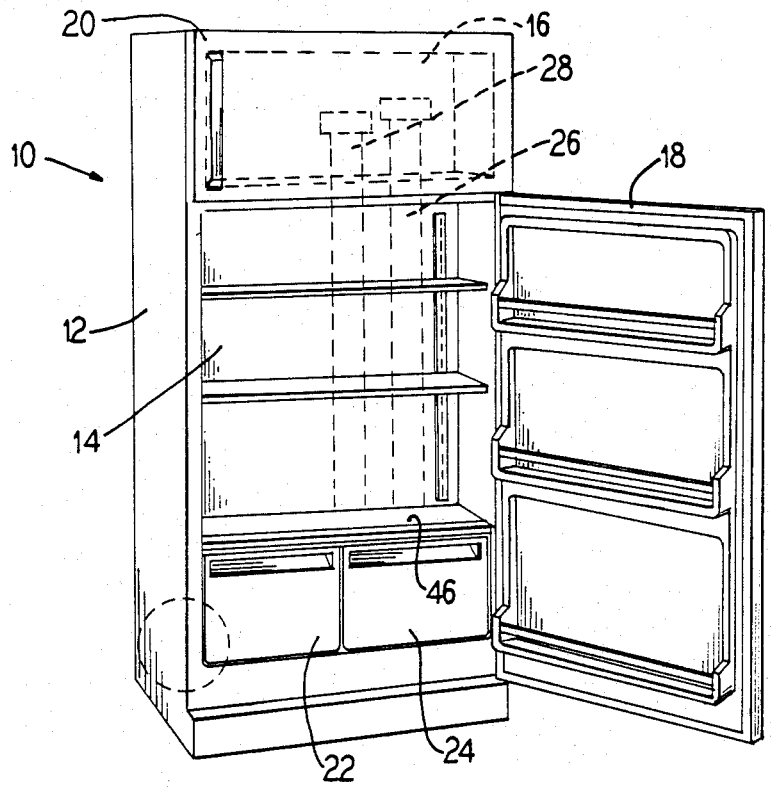
FIG. 1
FIG. 2
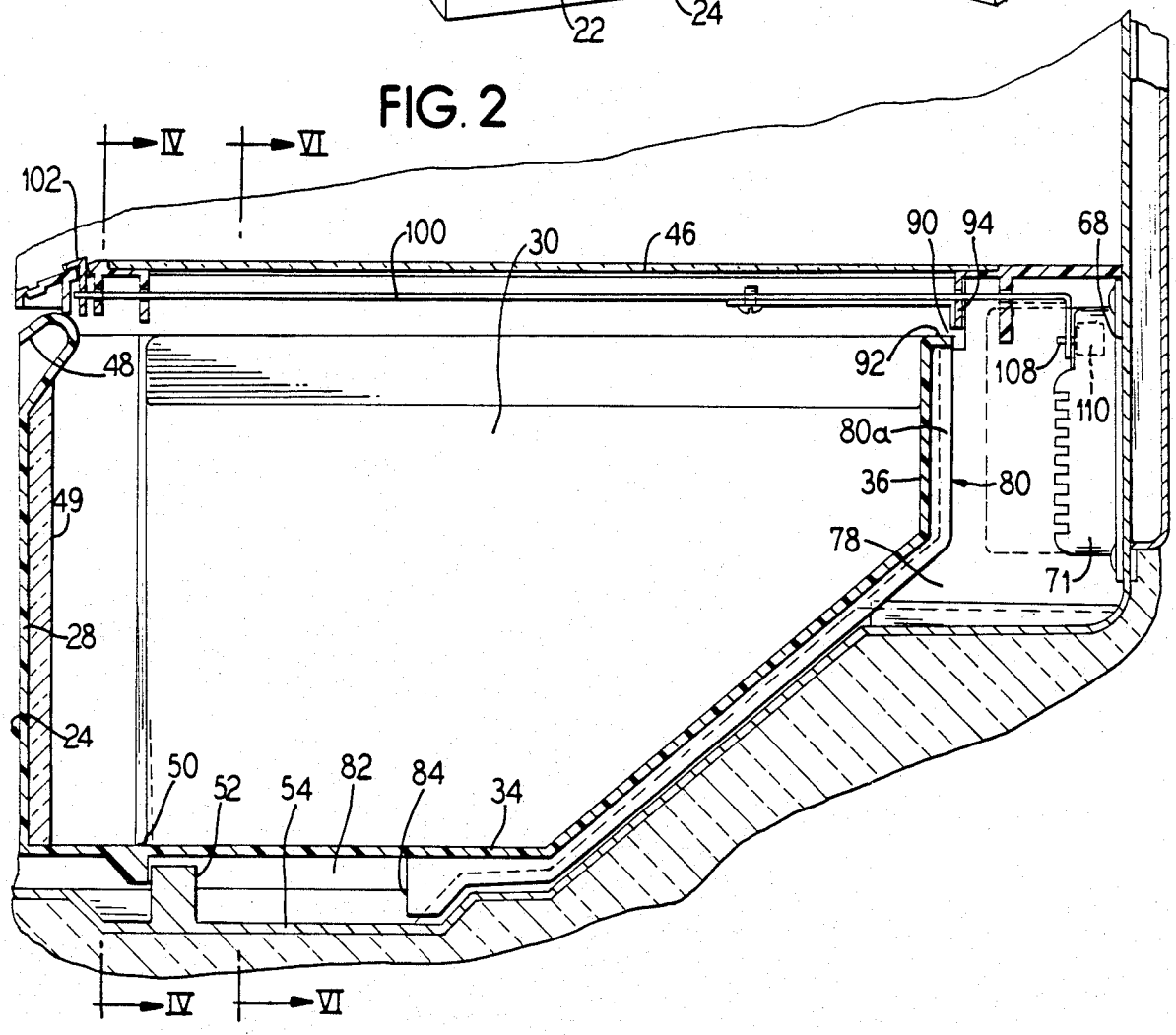

TEMPERATURE CONTROLLED COMPARTMENT FOR A REFRIGERATOR

BACKGROUND OF THE INVENTION

1. Field of the Invention

The present invention relates to refrigerators and more particularly to a refrigerator having a separate container or compartment therein to be chilled below the temperature of the remainder of the refrigerator compartment.

2. Description of the Prior Art

Separately cooled containers or compartments are utilized in refrigerators for the storage of various food items. U.S. Pat. No. 3,600,905 describes a food drawer 55 which comprises a high humidity compartment that is slidable in and out of a portion of the refrigerator compartment and is chilled by subfreezing air ducted into a sleeve spaced around the side, rear and bottom walls of the drawer. The air is prevented from entering the interior of the drawer.

U.S. Pat. No. 4,229,945 describes a refrigerator having a meat keeper pan 20 that has a flow of cold air directed around it. The drawer is covered to prevent any circulation of air within the fresh food compartment 5 from tending to dry out the food items maintained in the meat keeper pan 20.

U.S. Pat. No. 3,659,429 discloses a refrigerator-freezer with a fast chill space in the upper portion of the refrigerator compartment which utilizes an auxiliary fan to draw sub-freezing air into the refrigerator compartment to cool the fast chill space.

U.S. Pat. No. 3,364,694 discloses a refrigerator apparatus which includes a storage compartment having side and bottom walls in the form of an enclosing hollow jacket together with conduit for directing chilled air to the hollow interior of the jacket for flow of chilled air into the jacket so that material stored in the compartment will be maintained in a chilled condition by the heat conducting walls of the jacket without direct contact of the chilled air with the material.

Applicants have found that presently available chilled compartments have a wide degree of temperature variation throughout their volume which leads to inconsistant food storage results. Thus, it would be an improvement in the art to provide a chilled compartment for a refrigerator that maintains a minimal temperature gradient throughout its volume.

SUMMARY OF THE INVENTION

The present invention provides a "super-chill" compartment for use within a refrigerator in which the temperature gradient throughout the volume of the compartment and a container within the compartment is reduced to a minimum. That is, the temperature is maintained virtually constant at all points within the compartment. In order to provide a minimum temperature gradient, which will assure an even chilling of food articles within the compartment, the compartment is provided, by means of duct work, with a flow of chilled air which washes the outer surfaces of the container sidewalls and is permitted to enter the interior of the container through a first aperture in the container adjacent to the intersection of a side wall and the front wall. The chilled air can exit the container through a second aperture in the container adjacent the intersection of an opposite side wall and the front wall, and can also flow through the container and exit the container through a gap between the top of the rear wall and a support shelf. In this manner, the temperature within the container is maintained virtually constant at all locations within the container, thus greatly improving the storage characteristics of the container.

BRIEF DESCRIPTION OF THE DRAWINGS

FIG. 1 is a perspective illustration of a refrigerator embodying the principles of the present invention.

FIG. 2 is a side sectional view of the "super chill" compartment and associated duct work incorporating the principles of the present invention.

DESCRIPTION OF THE PREFERRED EMBODIMENTS

Figure 3:
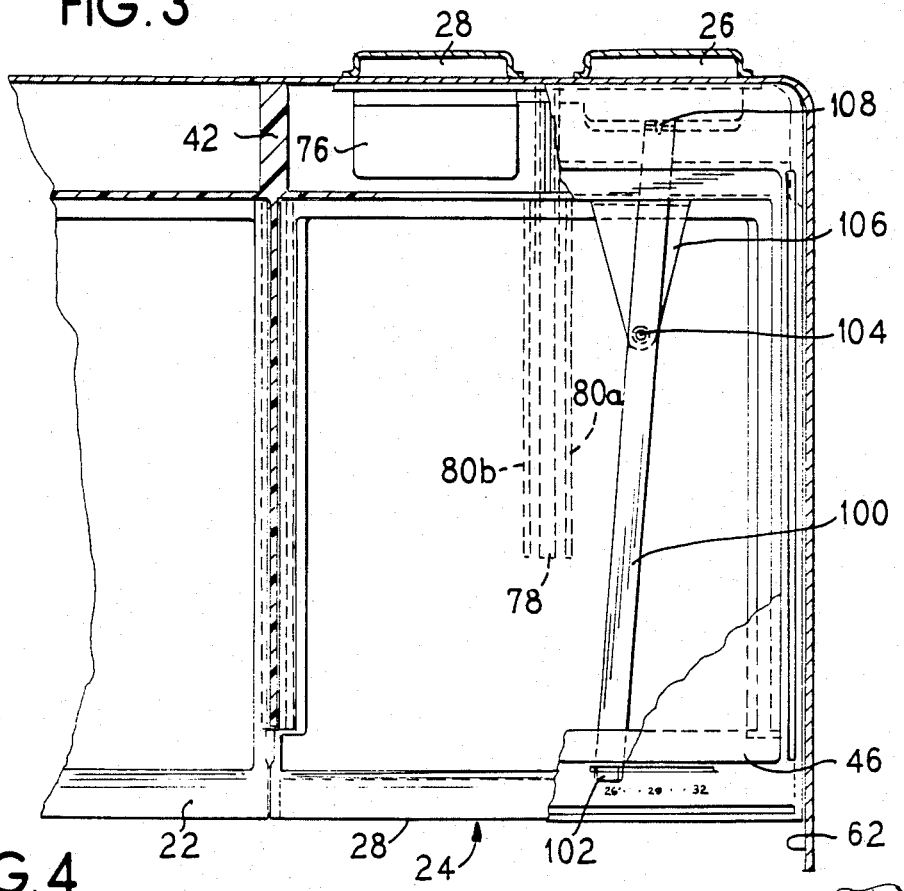
FIG. 3 is a top view of the "super chill" compartment, partially broken away.
Figure 4:
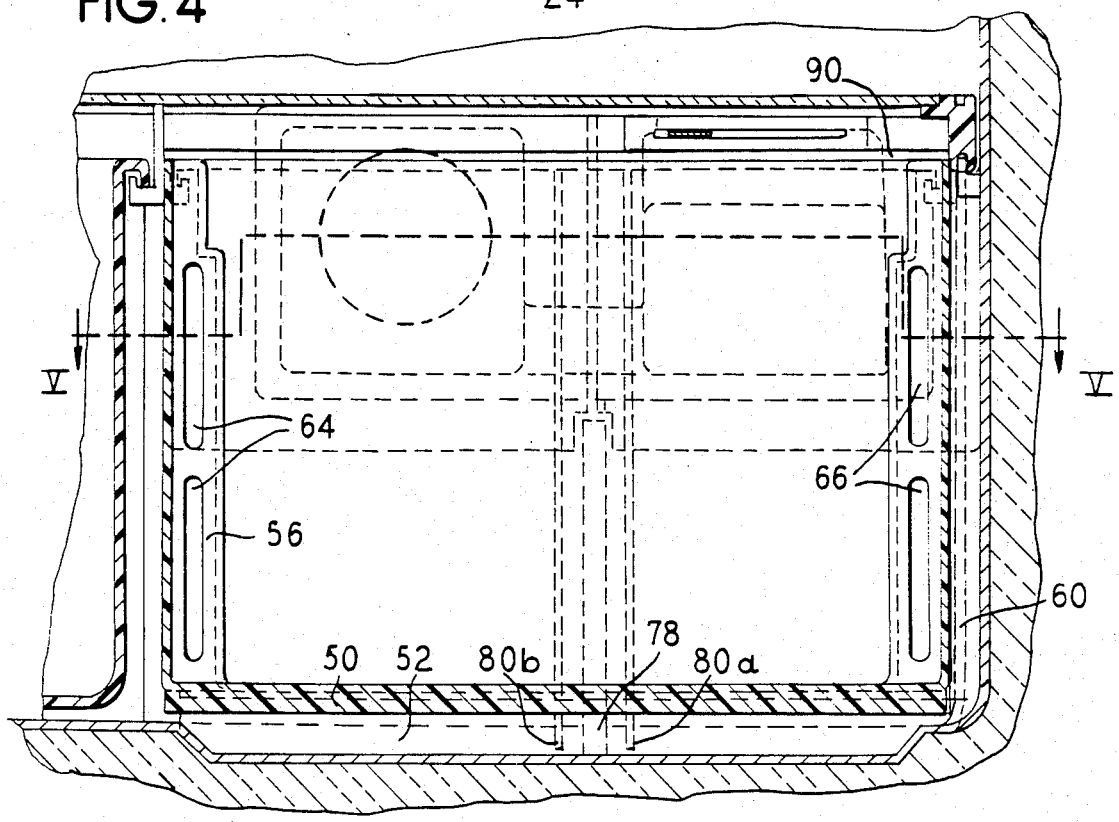
FIG. 4 is a front sectional view of the "super chill" compartment taken generally along the line IV—IV of FIG. 2.

An exemplary embodiment of the invention is shown which illustrates a refrigerator generally at 10 having a cabinet 12 divided into a refrigerator compartment 14 and a freezer compartment 16. Separate openable doors 18, 20 are provided for the refrigerator and freezer compartments respectively.

Within the refrigerator compartment there are provided separate storage drawers 22, 24, drawer 24 being a "super chill" container.

The "super chill" container 24 communicates with the freezer compartment 16 through two conduits 26, 28 which, as is described below, supply the "super chill" container 24 with a flow of chilled or temperature conditioned air.

Figure 5:
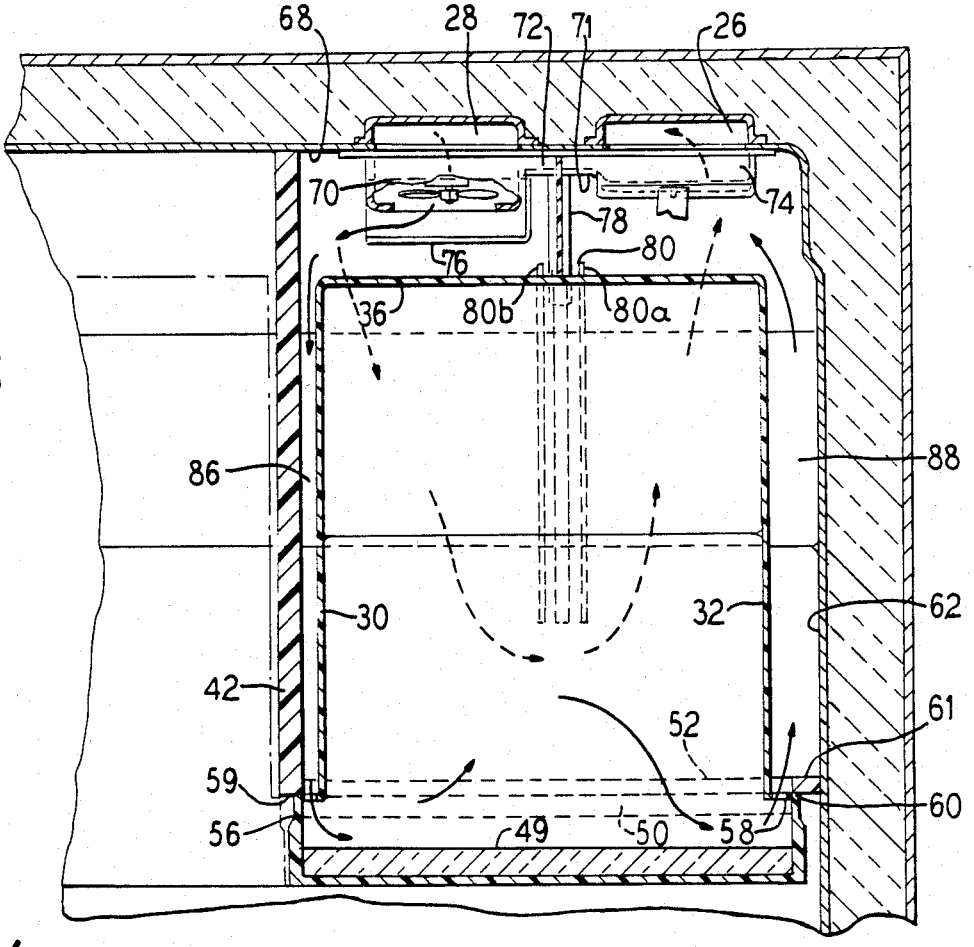
FIG. 5 is a top sectional view taken generally along the line V—V of FIG. 4.
Figure 6:
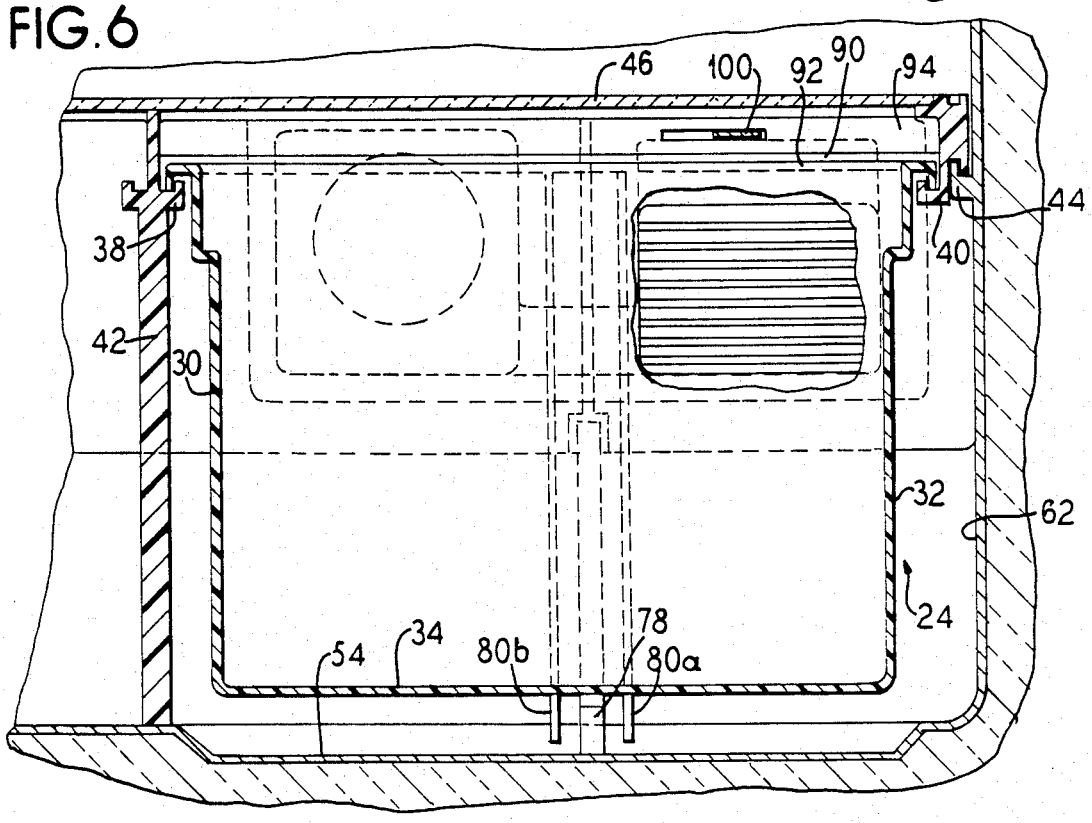
FIG. 6 is a front sectional view taken generally along the line VI—VI of FIG. 2.

The "super chill" container 24 as seen in greater detail in FIGS. 2-6 comprises a movable container having generally imperforate front 28, side 30, 32, bottom 34 and rear 36 walls with an open top side. As best seen in FIG. 6, the container 24 is carried on support rails 38, 40 which are slidingly engaged by downwardly turned top ends of the side walls 30, 32. The side rail 38 may be a part of and carried by a central wall 42 dividing the storage space between drawers 22 and 24. The rail 40 may be supported on a bracket member 44 formed as a part of the interior side wall of the refrigerator cabinet.

A support shelf 46 is carried above the drawers 22, 24 in a fixed position, also being supported directly or indirectly by the separation wall 42 and the support bracket 44. The "super chill" drawer has a manually accessed handle 48 formed near a top end of the front wall 28 to permit the manual grasping and pulling of the drawer in a sliding arrangement to an extended access position from a normally retracted article preservation position to provide access to the open top for placing and removing articles to be preserved. The front wall may also be provided with a layer of insulating material 49 to assist in maintaining the minimal temperature gradient within the container.

When the container 24 is returned to the retracted position a downwardly projecting stop wall 50, which projects downwardly below the bottom wall 34 of the container, engages against an upstanding stop wall 52 formed on an interior bottom wall 54 of the refrigerator compartment. The engagement of the two stop walls 50, 52 extends across the entire lateral width of the container and provides an air seal along the front bottom edge of the container 24.

As best seen in FIG. 5, the front wall 28 has a width greater than a rear portion of the container and the front wall 28 intersects with the side walls 30, 32 by means of rearwardly and then inwardly directed connecting wall portions 56, 58 which extend first perpendicularly and then generally parallel to a front face of the front wall 28. Laterally outer corner edges 59, 60 of the connecting walls 56, 58 engage respectively with the center wall partition 42 and an inwardly projecting stop wall member 61 formed on an interior side wall 62 of the refrigerator. Therefore when the container is moved to the retracted position, the side walls 56, 58 engage with the separation wall 42 and stop wall 60, respectively to provide an effective air seal at those points. The connecting walls 56, 58 are provided with apertures 64, 66 therein, (see FIG. 4) which permit an air communication between the interior and exterior of the container.

Thus, the container 24 is received in a comparment 67 defined by the partition wall 42, the interior bottom wall 54 of the refrigerator, an interior side wall 62 of the refrigerator, the support shelf 46 and a rear interior wall 68 of the refrigerator. When the container is placed in the retracted position the compartment 67 is effectively sealed off from the remainder of the refrigerator cabinet due to the abutment of the container walls with the partition wall 42 and stop walls 60, 52.

As was mentioned above, the chilled container communicates with the freezer compartment 16 which includes a cooling means, such as an evaporator connected to a compressor 69 (not shown), as is known to those skilled in the art, by means of conduits 26 and 28, seen in FIGS. 1 and 5. A circulating fan 70 is provided in an air conduit housing 71 to cause a stream of temperature conditioned air to flow into the "super chill" container 24 and compartment 67. The air is partially drawn through a connecting or bypass passage 72 from a return portion 74 of the air conduit housing 71 so that a blended stream of air, preferably at or above freezing, is directed into the chill compartment. The air drawn from the freezer compartment 16 through conduit 28 is replaced by return air flowing up from the chill compartment through conduit 26 back to the freezer. Due to the sealing of the container within the compartment, the airstream flows in a circuitous manner through the compartment 67 and container 24 and the freezer compartment, isolated from the remainder of the refrigerator compartment.

The air directed into the "super chill" compartment is caused to flow forwardly along an outer surface of the container side wall 30 by means of a first baffle 76 positioned in front of the fan 70 as well as by means of second baffle comprising a sealing, short circuit prevention wall 78 which engages into a labyrinth type seal 80 formed on the outside of the back 36 and partially along the bottom 34 walls of the container.

The labyrinth type seal 80 comprises a pair of spaced apart walls **80*a*, 80*b*, which depend downwardly from the bottom wall 34 of the container as well as the sloping and vertical rear wall 36. The two spaced walls receive therebetween the short circuit prevention wall 78 which extends from an uppermost portion which separates in flow and out flow portions of the air conduit housing 71 and contains a lower portion which extends beneath the rear and bottom walls of the container, but terminates short of the laterally extending stop wall 52 upstanding from the bottom wall 54 of the refrigerator compartment. Thus, a gap 82 is provided between a forward edge 84 of the labyrinth seal and the lateral stop wall 52, beneath the bottom wall 34 of the container so that air may flow beneath the container. This air flow is illustrated by dashed arrows in FIG. 5**.

Another portion of the air stream from the fan 70 comprising a substantial portion of the airstream is illustrated in FIG. 5 in full arrows which flows through a space 86 between the side wall 30 of the container and the separation wall 42 thereby washing the outer surface of the container side wall 30. The air flows into the container through apertures 64 in the connecting wall 56 to flow across and wash the interior of the front wall 28. A portion of the air washes across the front wall and exits the container through the aperture 66 in the connecting wall 58 to flow through a space 88 between the side wall 32 and the refrigerator side wall 62. This portion of the air stream thus washes the outer surface of container side wall 32. A final portion of the air stream which has entered into the container flows through the container and exits through an aperture or gap 90 between a top edge 92 of the container rear wall 36 and a downwardly extending cross brace 94 for the shelf 46 to return to the air conduit housing.

The set point temperature within the "super chill" compartment can be adjusted through the use of a control lever 100 which has a manually accessible tab portion 102 accessible at a front edge of the support shelf 46 and which is slidable laterally between various control positions which may be marked with indicia as illustrated in FIG. 3 to give the user an indication of the temperature selected for within the "super chill" compartment. The control lever 100 is pivotally attached at 104 to a support bracket 106 and from there continues rearwardly to engage a multiple-position slide switch 108 which is operably connected to a temperature control device 110 which operatively controls the energization of fan 70. For further information on the operation of temperature control device 110, reference is made to U.S. patent application Ser. No. 878,674 filed June 26, 1986 and owned by the assignee of the present invention, which is hereby incorporated herein by reference. Thus, by a sliding adjustment of the lever arm 100, the setting of the temperature control device 110 is effected, resulting in a selection of the desired temperature within the "super chill" compartment.

As is apparent from the foregoing specification, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. A refrigerator comprising:

a cabinet;

cooling means for providing a stream of temperature conditioned air within said cabinet;

a compartment within said cabinet defined by a pair of side walls, a top wall, a bottom wall and a rear wall;

a container within said compartment having side walls, rear wall, bottom wall and a front wall;

said container walls being spaced inwardly from said compartment walls to form an airspace therebetween;

said container being openable to provide access to the interior thereof for the placement and removal of articles to be preserved;

said container having apertures therethrough near each corner of said side walls and said front wall;

means to direct said stream of air forwardly along an outer surface of one of said side walls toward said apertures; and means to direct said stream of air rearwardly along an outer surface of another of said side walls from said apertures;

whereby the stream of conditioned air will wash the outer surfaces of the container side walls and the inner surface of the container front wall to produce a minimal temperature gradient inside the container.

2. A refrigerator according to claim 1, wherein said container is slidably received in said compartment to move between a retracted article preservation position and an extended access position.

3. A refrigerator according to claim 1, wherein said means for directing an airstream includes a fan means and baffle means.

4. A refrigerator according to claim 3, wherein said baffle means includes baffle means extending between said container rear wall and said compartment rear wall.

5. A refrigerator according to claim 4, wherein said baffle means also extends between a portion of the length of said container bottom wall and compartment bottom wall.

6. A refrigerator according to claim 3, wherein said fan means is positioned in a housing located in a space between said container rear wall and said compartment rear wall, said housing having an inlet and an outlet, each connected by conduit to the vicinity of said cooling means to provide for a circuitous flow of air through said compartment and past said cooling means.

7. A refrigerator according to claim 6, wherein said fan housing includes a bypass passage between said inlet and said outlet such that a portion of said airstream will be short circuited to avoid said cooling means.

8. A refrigerator according to claim 1, wherein sealing means are provided between said compartment walls and said container walls when said container is in a closed position to seal said container from the remainder of said refrigerator cabinet.

9. A refrigerator according to claim 1, wherein said container has an aperature at said rear wall to permit a portion of said airstream to flow through said container.

10. A refrigerator according to claim 1, including a manually adjustable temperature control device for adjusting the temperature within said container.

11. In a refrigerator having a cabinet and cooling means for providing a stream of temperature conditioned air within said cabinet, a temperature conditioned compartment having side walls, a top wall, a rear wall and a bottom wall comprising:

a movable container having generally imperforate front, side, rear and bottom walls, said container having access means at the top for placing and removing articles to be preserved;

means to facilitate movement of the container from a retracted article preservation position in said compartment to an extended access position;

means to direct said stream of air forwardly along an outer surface of one of said container side walls;

a first aperture in said container adjacent an intersection of said one container side wall and said front wall;

a second aperture in said container adjacent an intersection of another container side wall and said front wall;

a gap between a top edge of said container rear wall and said compartment top wall; and means to direct said stream of air rearwardly along an outer surface of said another container side wall;

whereby, the stream of conditioned air will wash the outer surfaces of the container side walls and the inner surface of the container front wall and a portion thereof will flow through said container to exit through said gap to produce a minimal temperature gradient inside the container.

12. A refrigerator according to claim 11, wherein said means for directing said stream of air includes a fan means and baffle means.

13. A refrigerator according to claim 12, wherein said baffle means includes baffle means extending between said container rear wall and said compartment rear wall.

14. A refrigerator according to claim 13, wherein said baffle means also extends between a portion of the length of said container bottom wall and compartment bottom wall.

15. A refrigerator according to claim 12, wherein said fan means is positioned in a housing located in a space between said container rear wall and said compartment rear wall, said housing having an inlet and an outlet, each connected by conduit to the vicinity of said cooling means to provide for a circuitous flow of air through said compartment and past said cooling means.

16. A refrigerator according to claim 15, wherein said fan housing includes a bypass passage between said inlet and said outlet such that a portion of said airstream will be short circuited to avoid said cooling means.

17. A refrigerator according to claim 11, wherein sealing means are provided between said compartment walls and said container walls when said container is in a closed position to seal said container from the remainder of said refrigerator cabinet.

18. A refrigerator according to claim 11, including a manually adjustable temperature control device for adjusting the temperature within said container.

19. A refrigerator comprising:

a cabinet;

cooling means for providing a stream of temperature conditioned air within said cabinet;

a compartment within said cabinet defined by a pair of side walls, a top wall, a bottom wall and a rear wall;

a container within said compartment having side walls, rear wall, bottom wall and a front wall;

said container walls being spaced inwardly from said compartment walls to form an airspace therebetween;

said container being openable to provide access to the interior thereof for the placement and removal of articles to be preserved;

said container having apertures therethrough to permit said air stream to enter said container;

means to direct said stream of air in a circuitous path around an outer surface of said side walls, in and out of said apertures and past said cooling means;

bypass means to prevent a portion of the airstream from flowing past said cooling means; and sealing means provided between said compartment walls and said container walls when said container is in a closed position to seal said container from the remainder of said refrigerator cabinet;

whereby the stream of conditioned air will wash the outer surfaces of the container side walls and the interior of the container to produce a minimal temperature gradient inside the container.

20. A refrigerator according to claim 19, wherein said container is slidably received in said compartment to move between a retracted article preservation position and an extended access position.

21. A refrigerator according to claim 19, wherein said means for directing an airstream includes a fan means and baffle means.

22. A refrigerator according to claim 21, wherein said baffle means includes baffle means extending between said container rear wall and said compartment rear wall.

23. A refrigerator according to claim 22, wherein said baffle means also extends between a portion of the length of said container bottom wall and compartment bottom wall.

24. A refrigerator according to claim 21, wherein said fan means is positioned in a housing located in a space between said container rear wall and said compartment rear wall, said housing having an inlet and an outlet, each connected by conduit to the vicinity of said cooling means to provide for said circuitous flow of air through said compartment and past said cooling means.

25. A refrigerator according to claim 24, wherein said bypass means comprises a bypass passage between said inlet and said outlet.

26. A refrigerator according to claim 19, wherein said container has an aperture at said rear wall to permit a portion of said airstream to flow through said container.

27. A refrigerator according to claim 19, including a manually adjustable temperature control device for adjusting the temperature within said container.

* * * * *